US008888461B2

(12) United States Patent
Smarsly et al.

(10) Patent No.: US 8,888,461 B2
(45) Date of Patent: Nov. 18, 2014

(54) MATERIAL FOR A GAS TURBINE COMPONENT, METHOD FOR PRODUCING A GAS TURBINE COMPONENT AND GAS TURBINE COMPONENT

(75) Inventors: Wilfried Smarsly, Munich (DE); Helmut Clemens, Leoben (AT); Volker Guether, Burgthann (DE); Sascha Kremmer, Kraubath (AT); Andreas Otto, Rosstal (DE); Harald Chladil, Trofaiach (AT)

(73) Assignees: MTU Aero Engines GmbH, Munich (DE); Montanuniversitaet Leoben, Leoben (AT); Boehler Schmiedetechnik GmbH & Co. KG, Kapfenberg (AT); GFE Metalle Unf Materialien GmbH, Nuernberg (DE)

( * ) Notice: Subject to any disclaimer, the term of this patent is extended or adjusted under 35 U.S.C. 154(b) by 1178 days.

(21) Appl. No.: 12/739,929

(22) PCT Filed: Oct. 18, 2008

(86) PCT No.: PCT/DE2008/001702

§ 371 (c)(1),
(2), (4) Date: Apr. 21, 2011

(87) PCT Pub. No.: WO2009/052792

PCT Pub. Date: Apr. 30, 2009

(65) Prior Publication Data

US 2011/0189026 A1 Aug. 4, 2011

(30) Foreign Application Priority Data

Oct. 27, 2007 (DE) ..... 10 2007 051 499

(51) Int. Cl.

| | |
|---|---|
| ***F01D 5/14*** | (2006.01) |
| ***C22F 1/18*** | (2006.01) |
| ***C22C 14/00*** | (2006.01) |

(52) U.S. Cl.

CPC ..... *C22C 14/00* (2013.01); *C22F 1/183* (2013.01)

USPC ..... 416/223 R; 416/241 R; 415/200; 420/418; 420/580

(58) Field of Classification Search

CPC ..... F01D 5/14; F01D 5/28; F01D 5/286; F01D 25/005; F01D 25/007; C22C 14/00; C22F 1/183

USPC ..... 416/223 R, 241 R; 415/200; 420/418, 420/580

See application file for complete search history.

(56) References Cited

U.S. PATENT DOCUMENTS 5,232,661 A * 8/1993 Matsuo et al. ..... 420/421
5,431,754 A * 7/1995 Fujiwara et al. ..... 148/669

(Continued)

FOREIGN PATENT DOCUMENTS

DE 10 2004 056 582 A1 6/2006
EP 592 189 A1 4/1994

OTHER PUBLICATIONS

R.M. Imayev, et al, "Alloy design concepts for refined gamma titanium aluminide based alloys", Intermetallics, Jan. 29, 2007, XP005924292, pp. 451-460.

(Continued)

*Primary Examiner* — Igor Kershteyn
(74) *Attorney, Agent, or Firm* — Crowell & Moring LLP

(57) ABSTRACT

A material for a gas turbine component, to be specific a titanium-aluminum-based alloy material, including at least titanium and aluminum. The material has a) in the range of room temperature, the β/B2-Ti phase, the $\alpha_2$-$Ti_3Al$ phase and the γ-TiAl phase with a proportion of the β/B2-Ti phase of at most 5% by volume, and b) in the range of the eutectoid temperature, the β/B2-Ti phase, the $\alpha_2$-$Ti_3Al$ phase and the γ-TiAl phase, with a proportion of the β/B2-Ti phase of at least 10% by volume.

14 Claims, 1 Drawing Sheet

(56) References Cited

U.S. PATENT DOCUMENTS

| | | | | |
|---|---|---|---|---|
| H1659 | H | 7/1997 | Semiatin et al. | |
| 6,051,084 | A * | 4/2000 | Tetsui | 148/421 |
| 6,174,387 | B1 * | 1/2001 | Bellows et al. | 148/421 |
| 6,294,132 | B1 * | 9/2001 | Tetsui | 420/418 |
| 2010/0015005 | A1 * | 1/2010 | Oehring et al. | 420/580 |
| 2012/0263623 | A1 * | 10/2012 | Oehring et al. | 420/418 |

OTHER PUBLICATIONS

Satoru Kobayashi, et al., "Microstructure Control Using β-Titanium Phase for Wrought Gamma TIAL Based Alloys", Gamma Titanium Aluminides 2003, Proceedings of [A] Symposium Held During The TMS Annual Meeting, Mar. 2-6, 2003, pp. 165-175, XP009110846, Minerals, San Diego, CA, U.S.A.

Volker Guether, et al., "Microstructure and Corresponding Tensile Properties of As-Cast, β-Solidifying, γ-TIAL Based TNM alloys", Structural Aluminides for Elevated Temperatures; Gamma Titanium and Other Metallic Aluminides, Proceedings of [A] Symposium Held During [The] TMS Annual Meeting & Exhibition, Mar. 9-13, 2008, pp. 249-256, XP009110850, New Orleans, LA, U.S.A.

R.M. Imaev, et al., "Refining of the Microstructure of Cast Intermetallic Alloy Ti—43% Al—X (Nb, Mo, B) With the Help of Heat Treatment", Metal Science and Heat Treatment, 2006, pp. 81-84, vol. 48, Nos. 1-2, XP002510776.

* cited by examiner

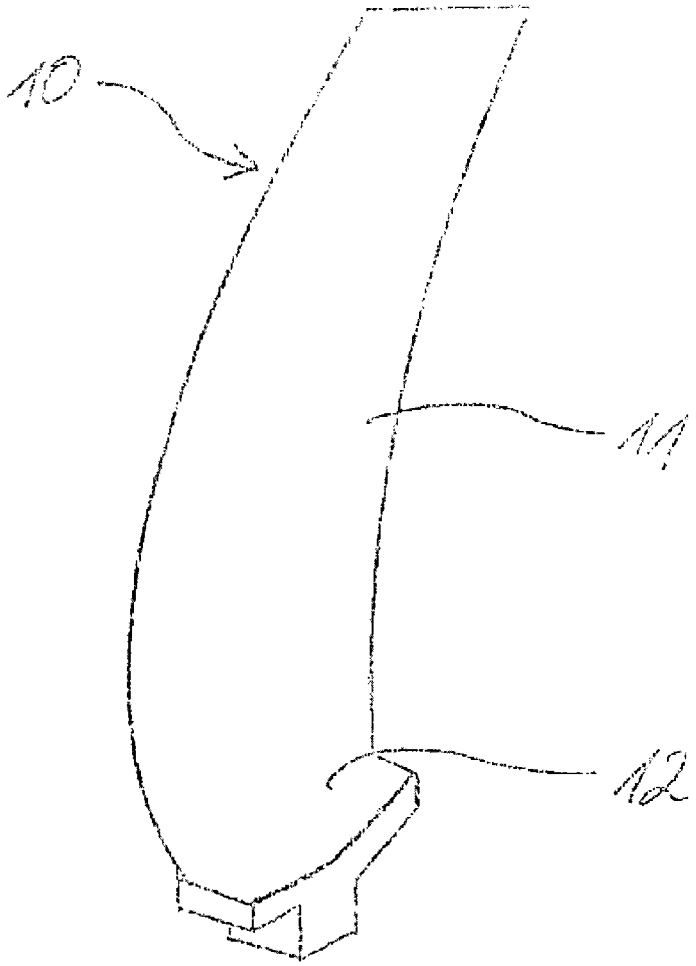
10
11
12

MATERIAL FOR A GAS TURBINE COMPONENT, METHOD FOR PRODUCING A GAS TURBINE COMPONENT AND GAS TURBINE COMPONENT

This application claims the priority of International Application No. PCT/DE2008/001702, filed Oct. 18, 2008, and German Patent Document No. 10 2007 051 499.0, filed Oct. 27, 2007, the disclosures of which are expressly incorporated by reference herein.

BACKGROUND AND SUMMARY OF THE INVENTION

The invention relates to a material for a gas turbine component. In addition, the invention relates to a method for producing a gas turbine component as well as a gas turbine component.

Modern gas turbines, in particular aircraft engines, must meet extremely high demands with regard to reliability, weight, power, economy and service life. In recent decades, aircraft engines that fully meet the requirements listed above and have achieved a high level of technical perfection have been developed, especially in the civilian sector. The choice of materials, the search for suitable new materials and novel production methods, among other things, have played a decisive role in the development of aircraft engines.

The most important materials used nowadays for aircraft engines or other gas turbines are titanium alloys, nickel alloys (also called superalloys) and high strength steels. High strength steels are used for shaft parts, gear parts, the compressor housing and the turbine housing. Titanium alloys are typical materials for compressor parts. Nickel alloys are suitable for the hot parts of the aircraft engine.

Precision casting and forging are the main production methods known from the prior art as production methods for gas turbine components made of titanium alloys, nickel alloy or other alloys. All highly stressed gas turbine components such as, for example, components for a compressor, are forged parts. However, components for a turbine are usually designed as precision cast parts.

Fabricating gas turbine components from titanium-aluminum-based alloy materials is already known from practice. In this case, γ-TiAl-based alloy materials are used in particular, wherein forging these types of γ-TiAl-based alloy materials is problematic. Forged parts from these types of materials must be produced in practice by isothermal forging or hot-die forging of preformed, such as, for example, extruded, semi-finished products. Isothermal forging as well as hot-die forging requires quasi-isothermal extruded primary material, resulting in high production costs.

As a result, there is a need for an adaptive forging method that uses a new material for producing gas turbine components. This method should guarantee an improved process reliability with reduced production costs.

From this starting point, the objective of the present invention is creating a novel material for a gas turbine component, a novel method for producing a gas turbine component as well as a novel gas turbine component.

According to the invention, the material has a) in the range of room temperature, the β/B2-Ti phase, the $\alpha_2$-$Ti_3Al$ phase and the γ-TiAl phase with a proportion of the β/B2-Ti phase of at most 5% by volume; b) in the range of the eutectoid temperature, has the β/B2-Ti phase, the α2-$Ti_3Al$ phase and the γ-TiAl phase with a proportion of the β/B2-Ti phase of at least 10% by volume.

The material according to the invention, which is a γ-TiAl-based alloy material, allows forging within a greater temperature range. A cast material can be used as the primary material for forging, making it possible to dispense with expensive extrusion material.

The method according to the invention for producing a gas turbine component is defined in the claims and the gas turbine component according to the invention is defined in the claims.

Preferred further developments of the invention are disclosed in the following description. Without being limited hereto, exemplary embodiments of the invention are explained in greater detail on the basis of the drawing.

BRIEF DESCRIPTION OF THE DRAWING

FIG. 1 is a very schematized representation of a blade of a gas turbine produced from a material according to the invention by a method according to the invention.

DETAILED DESCRIPTION OF THE DRAWING

The present invention relates to a new material for a gas turbine component, to be specific a material based on a titanium-aluminum alloy. The material according to the invention includes several phases both in the range of room temperature as well as in the range of the so-called eutectoid temperature.

In the range of room temperature, the TiAl-based alloy material according to the invention has the β/B2-Ti phase, the α2-$Ti_3Al$ phase and the γ-TiAl phase, wherein the proportion of the β/B2-Ti phase at room temperature is at most or a maximum of 5% by volume. In the range of the eutectoid temperature, the TiAl-based alloy material according to the invention has the β/B2-Ti phase, the $\alpha_2$-$Ti_3Al$ phase and the γ-TiAl phase, wherein the proportion of the β/B2-Ti phase in the range of the eutectoid temperature is at least or a minimum of 10% by volume.

The material according to the invention is consequently a γ-TiAl-based alloy material. The material can be formed with conventional forging methods, and namely at a forging temperature within a relatively large temperature range. The forging temperature of the material according to the invention lies preferably between $T_e$-50 K and $T_a$+100 K, wherein $T_e$ is the eutectoid temperature of the material and $T_a$ is the alpha transus temperature of the material.

If the forging temperature or the forming temperature is below $T_a$, as well as in the range of the forging temperature or forming temperature as well as in the range of the eutectoid temperature and the room temperature, the β/B2-Ti, $\alpha_2Ti_3Al$ and γ-TiAl phases are in thermodynamic equilibrium.

The proportion of the body-centered cubic β/B2-Ti phase in thermodynamic equilibrium of the material according to the invention is less than 5% by volume in the range of room temperature. In the range of the eutectoid temperature, the proportion of the body-centered cubic β/B2-Ti phase is greater than 10% by volume.

In addition to titanium and aluminum, the γ-TiAl-based alloy material also features niobium, molybdenum and/or manganese as well as boron and/or carbon and/or silicon.

The titanium-aluminum-based alloy material preferably has the following composition:

42 to 45 atomic percent aluminum, 3 to 8 atomic percent niobium, 0.2 to 3 atomic percent molybdenum and/or manganese, 0.1 to 1 atomic percent, preferably 0.1 to 0.5 atomic percent, boron and/or carbon and/or silicon, in the remainder of titanium.

To produce a gas turbine component from the material according to the invention, the procedure in terms of the method according to the invention is that, first of all, a semi-finished product or primary material made of the material in accordance with the invention is made available. In terms of the semi-finished product, this can be a cost-effective, cast semi-finished product. It can also be provided that the semi-finished product is a primary shaped component.

Then, in terms of the method according to the invention, the semi-finished product is formed from the γ-TiAl-based alloy material according to the invention by forging, to be specific at a forming temperature or forging temperature that is between $T_e$-50 K and $T_a$+100 K. In this case, forging is carried out at a forming rate of at least 1 m/s. In a preferred further development, the semi-finished product is coated with a thermal barrier prior to forging.

Following the forging, a heat treatment of the component being produced is preferably carried out.

Then, if, according to FIG. 1, a rotor blade 10 for a compressor of an aircraft engine is supposed to be produced as a gas turbine component, in the case of the method according to the invention, the preferred procedure is such that single forging is used in the region of a blade pan 11 for making a rougher microstructure with high creep resistance available and multiple forging is used in the region of a blade root 12 for making a finer microstructure with high ductility available, wherein a heat treatment preferably follows the single forging as well as the multiple forging.

Gas turbine components according to the invention are fabricated with the aid of the method according to the invention from the material according to the invention. The gas turbine components according to the invention are preferably compressor components, thus, for example, rotor blades of a compressor of an aircraft engine or turbine components.

The invention claimed is:

1. A material for a gas turbine component, comprising:
titanium; and
aluminum;
wherein:
a) the material has, in a range of room temperature, a β/B2-Ti phase, a α2-$Ti_3Al$ phase, and a γ-TiAl phase, with a proportion of the β/B2-Ti phase of at most 5% by volume;
b) and the material has, in a range of eutectoid temperature, the β/B2-Ti phase, the α2-$Ti_3Al$ phase, and the γ-TiAl phase, with a proportion of the β/B2-Ti phase of at least 10% by volume.

2. The material according to claim 1, wherein a proportion of a body-centered cubic β/B2-Ti phase in the range of room temperature is less than 5% by volume.

3. The material according to claim 1, wherein a proportion of a body-centered cubic β/B2-Ti phase in the range of eutectoid temperature is greater than 10% by volume.

4. The material according to claim 1, wherein the β/B2-Ti, the $\alpha_2$-$Ti_3Al$, and the γ-TiAl phases are present in the range of room temperature.

5. The material according to claim 1, wherein the β/B2-Ti, the $\alpha_2Ti_3Al$, and the γ-TiAl phases are in thermodynamic equilibrium in the range of eutectoid temperature.

6. The material according to claim 1, further comprising:
niobium;
molybdenum and/or manganese; and
boron and/or carbon and/or silicon.

7. The material according to claim 6, wherein the material has:
42 to 45 atomic percent aluminum;
3 to 8 atomic percent niobium;
0.2 to 3 atomic percent molybdenum and/or manganese;
0.1 to 1 atomic percent boron and/or carbon and/or silicon; and
a remainder of titanium.

8. The material according to claim 1, wherein a forming temperature of the material lies between $T_e$−50 K and $T_a$+100 K, wherein $T_e$ is the eutectoid temperature of the material and $T_a$ is the alpha transus temperature of the material.

9. A method for producing a gas turbine component, comprising the steps of:
a) making available a semi-finished product from the material according to claim 1; and
b) forging the semi-finished product from the material into a component at a forming temperature between $T_e$−50 K and $T_a$+100 K, wherein $T_e$ is the eutectoid temperature of the material and $T_a$ is the alpha transus temperature of the material.

10. The method according to claim 9, wherein the forging is carried out at a forming rate of at least 1 m/s.

11. The method according to claim 9, wherein a heat treatment is carried out following the forging.

12. The method according to claim 9, wherein a cast semi-finished product is used as the semi-finished product.

13. A gas turbine component made of the material according to claim 1 and produced by the method according to claim 9.

14. The gas turbine component according to claim 13, wherein the component is a blade, which is singly forged in a region of a blade pan for making a rougher microstructure with high creep resistance available, and which is multiply forged in a region of a blade root for making a finer microstructure with high ductility available.

* * * * *